US006688723B2

(12) United States Patent
Anderson et al.

(10) Patent No.: US 6,688,723 B2
(45) **Date of Patent: *Feb. 10, 2004**

(54) TWO-STAGE SCRAPER SYSTEM FOR INKJET WIPERS

(75) Inventors: Jeffrey J. Anderson, Vancouver, WA (US); Michael S. Millman, Vancouver, WA (US); John A. Barinaga, Portland, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 130 days.

This patent is subject to a terminal disclaimer.

(21) Appl. No.: 10/114,390

(22) Filed: Apr. 1, 2002

(65) Prior Publication Data

US 2002/0130921 A1 Sep. 19, 2002

Related U.S. Application Data

(63) Continuation of application No. 09/540,595, filed on Mar. 31, 2000, now Pat. No. 6,409,303.

(51) Int. Cl.[7] ..... B41J 2/165
(52) U.S. Cl. ..... 347/33

(58) Field of Search ..... 347/22, 23, 28, 347/33

(56) References Cited

U.S. PATENT DOCUMENTS 6,409,303 B1 * 6/2002 Anderson et al. ..... 347/28

* cited by examiner

*Primary Examiner*—Shih-Wen Hsieh

(57) ABSTRACT

A two-stage scraper system having coarse and fine cleaning components is provided for cleaning ink residue from a wiper following wiping a printhead in an inkjet printing mechanism. A fixed, coarse scraper bar is sandwiched between a pair of moveable fine scraper bars. During the first scraping stage, the fine scrapers are retracted from the wiper path and the coarse scraper cleans one side of the wiper. During the second scraping stage, the fine scrapers move into the wiper path and one of the fine scrapers removes ink residue from the wiper tip. Moving bi-directionally, the wiper reverses to first encounter the coarse scraper, then the other fine scraper, removing ink residue from the other side and tip of the wiper. The fine scrapers may be absorbent or impregnated with an ink solvent. A method of cleaning printheads and inkjet printing mechanisms having two-stage wiper cleaning systems are also provided.

6 Claims, 12 Drawing Sheets

TWO-STAGE SCRAPER SYSTEM FOR INKJET WIPERS

CROSS REFERENCE TO RELATED APPLICATION(S)

This is a continuation of application number 09/540,595 filed on Mar. 31, 2000, now U.S. Pat. No. 6,409,303 which is hereby incorporated by reference herein.

FIELD OF THE INVENTION

The present invention relates generally to inkjet printing mechanisms, and more particularly to a two-stage scraper system having coarse and fine cleaning components for cleaning ink residue from a wiper which has removed the residue from an inkjet printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads. This wiping must be accomplished without any appreciable wear that could decrease printhead life, and without using excessive forces that could otherwise un-seat the pen from the carriage alignment datums.

In the past, the printhead wipers have been a single or dual wiper blade made of an elastomeric material. Typically, the printhead is translated across the wiper in a direction parallel to the scan axis of the printhead. In one printer, the wipers were rotated about an axis perpendicular to the printhead scan axis to wipe. Today, most inkjet pens have nozzles aligned in two linear arrays which run perpendicular to the scanning axis. Using these earlier wiping methods, first one row of nozzles was wiped and then the other row of nozzles was wiped. While these earlier wiping methods proved satisfactory for the traditional dye based inks, unfortunately, they were unacceptable for the newer fast drying pigment inks.

One suitable service station design for pigment-based inks was a rotary device first sold in the DeskJet® 850C and 855C color inkjet printers, and later in the DeskJet® 820C and 870C color inkjet printers by Hewlett-Packard Company of Palo Alto, Calif., the present assignee. This rotary device mounted the wipers, primers and caps on a motor-operated tumbler. These pens were wiped using an orthogonal wiping technique, where the wipers ran along the length of the linear nozzle arrays, wicking ink along the arrays from one nozzle to the next to serve as a solvent to break down ink residue accumulated on the nozzle plate. A camming device moved a horizontal arm carrying a wiper scraper into position to clean ink residue from the wipers as they rotated past. The scraper arm had capillary channels formed along the under surface from the scraper tip to an absorbent blotter pad. A translational or sliding orthogonal wiping system was first sold by the Hewlett-Packard Company in the DeskJet® 720C and 722C color inkjet printers. The wipers were slid under a stationary vertical, rigid plastic wiper bar to clean off any clinging ink residue. This wiper bar had an inverted T-shaped head which assisted in scraping the wipers clean.

Another wiper system using rotational and vertical motion was first sold in the Hewlett-Packard Company's model 2000C Professional Series color inkjet printer. This was one of the first service station systems in a Hewlett-Packard Company inkjet printer to use an ink solvent, specifically polyethylene glycol ("PEG" and in particular, PEG-300), to clean and lubricate the printheads. This service station required two motors to move the service station servicing components both vertically and rotationally. The PEG ink solvent was transferred to the wiper using a porous plastic dispenser which operated through wicking or capillary forces. For the dye-based inks, the porous wick applicator easily dispersed any dye residue that was transferred from the wiper to the wick. Unfortunately, when pigment based inks were used the pigment accumulated on the dispensing surface, often hindering further transfer of PEG to the wiper. As the amount of ink solvent transferred from the dispenser to the wiper decreased, the orifice plate cleanliness became degraded. As mentioned above, the cleanliness of the orifice plate is an important component of a long life, high usage printhead. If the orifice plate is not clean, transient or permanent nozzle outages, along with degraded print quality, are often experienced. Therefore, the effective life of the solvent dispenser was limited by the amount of ink residue transferred from the wiper to the dispenser.

Besides contamination of the solvent dispenser, ink residue remaining on the wipers may get pushed into the nozzles during the next wiping stroke, causing permanent or temporary nozzle blockages. While a permanent nozzle outage will lead to a permanent print defect, even a temporary nozzle outage may create print defects. For instance, one particular print defect, known to those skilled in the art as "SNOUTS," which is an acronym for "sudden nozzle outages," may be caused by a temporary nozzle blockage. A SNOUT print defect appears as a band without a desired color at the top of a page after a wiping event, with the blockage being cleared during the print job so the nozzle returns to normal printing for the remainder of the page.

Thus, it would be desirable to reduce the amount of residual ink residue on the wiper before applying fresh ink solvent to the wiper, in order to increase the life of the solvent dispenser and the printheads.

SUMMARY OF THE INVENTION

According to one aspect of the present invention, a two-stage scraper system for is provided for cleaning ink residue from a wiper which has wiped ink residue from an inkjet printhead in an inkjet printing mechanism. The wiper cleaning system includes a coarse scraper which removes the ink residue from a main body portion of the wiper through relative movement of the wiper and the coarse scraper, and leaves a portion of the ink residue remaining on a tip portion of the wiper. The wiper cleaning system also has a fine scraper which removes the remaining ink residue from the tip portion of the wiper through relative movement of the wiper and the fine scraper.

According to one aspect of the present invention, a method is provided for cleaning ink residue from an inkjet printhead in an inkjet printing mechanism. The method includes the step of providing a wiper, a coarse scraper, and a fine scraper, with the wiper having a main body portion and a tip portion. In a wiping step, ink residue is wiped from an inkjet printhead with the wiper and collected on the main body portion and tip portion of the wiper. Through relative movement of the wiper and the coarse scraper, in a one removing step, ink residue is removed from the main body portion of the wiper, leaving a portion of the ink residue remaining on a tip portion of the wiper. Finally, in another removing step, through relative movement of the wiper and the fine scraper, ink residue is removed from the tip portion of the wiper.

According to a further aspect of the present invention, an inkjet printing mechanism may be provided with a two-stage wiper cleaning system for cleaning ink residue from printhead wipers, as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a wiping system for cleaning printheads in an inkjet printing mechanism to prolong printhead life.

Still another goal of the present invention is to provide a printhead wiping system for cleaning printheads in an inkjet printing mechanism which provides consumers with a reliable, robust inkjet printing unit.

BRIEF DESCRIPTION OF THE DRAWINGS

FIGS. 4–7 are enlarged, side elevational views of the service station of FIG. 1 showing various stages of a pallet flip-down sequence, with:

FIG. 4 showing a first stage;

FIG. 5 showing a second stage;

FIG. 6 showing a third stage; and

FIG. 7 showing a fourth stage.

FIGS. 9–13 are enlarged, side elevational views of the service station of FIG. 1 showing various stages of a wiper scraping routine, with:

FIG. 9 showing an initial stage;

FIG. 10 showing a first coarse scraping stage;

FIG. 11 showing a first fine scraping stage;

FIG. 12 showing a second coarse scraping stage; and

FIG. 13 showing a second fine scraping stage.

FIGS. 14–17 are enlarged, side elevational views of the service station of FIG. 1 showing various beginning stages of a pallet flip-up sequence, with:

FIG. 14 showing a first stage;

FIG. 15 showing a second stage;

FIG. 16 showing a third stage; and

FIG. 17 showing a fourth stage.

FIGS. 18–19 are enlarged, front elevational views of the service station of FIG. 1 showing the operation of a detent member which holds the pallet either upright for wiping or inverted for scraping, with:

FIG. 18 showing the pallet upright for wiping; and

FIG. 19 showing the pallet inverted for scraping.

DETAILED DESCRIPTION OF A PREFERRED EMBODIMENT

Figure 1:
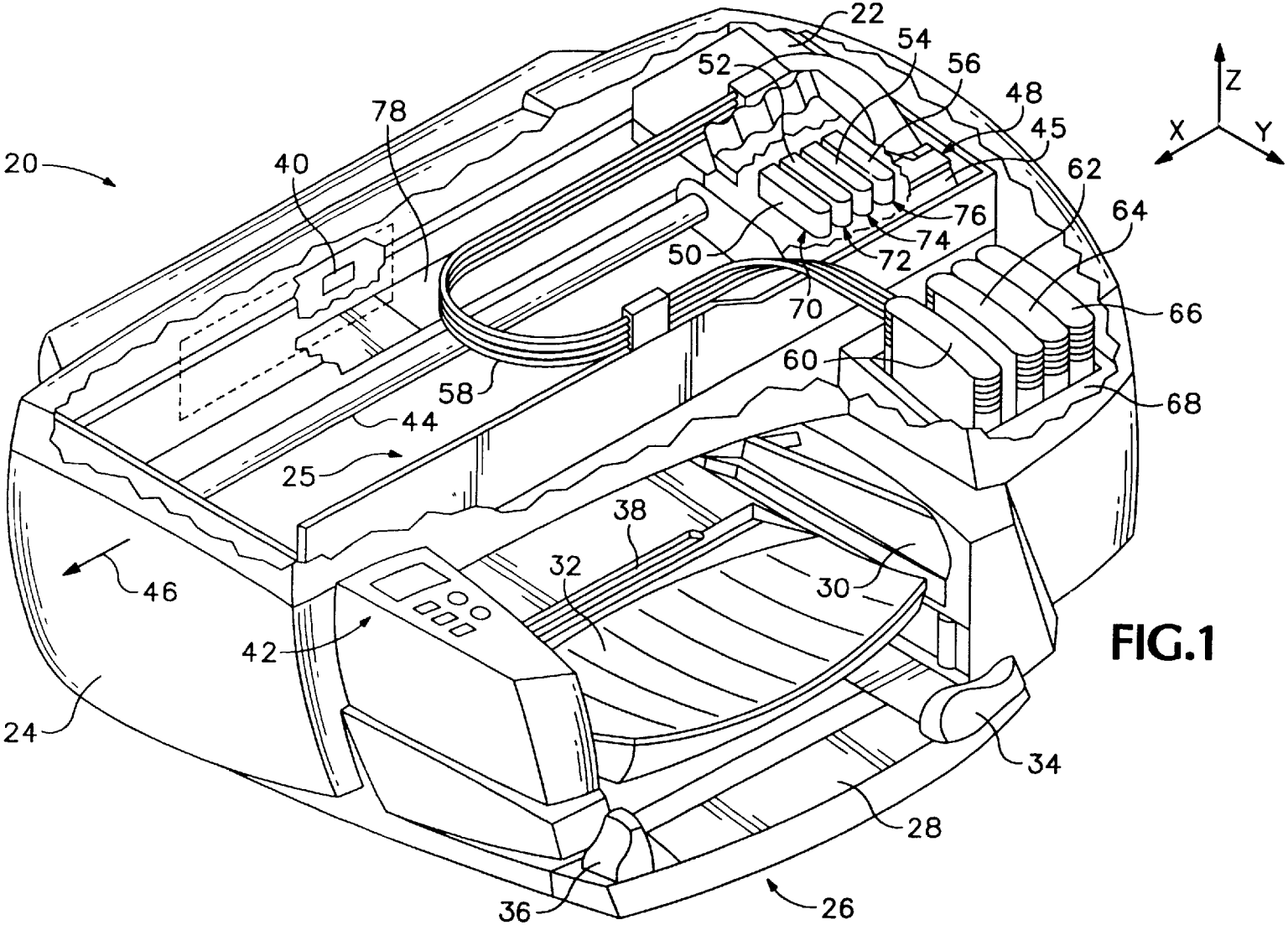
FIG. 1 is a perspective view of one form of an inkjet printing mechanism, here, an inkjet printer, including a printhead service station having one form of a two-stage scraper system of the present invention for removing ink residue from a wiper after cleaning the residue from an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a DC (direct current) motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the printzone 25, a media sheet receives ink from an inkjet cartridge, such as a black ink cartridge 50 and three monochrome color ink cartridges 52, 54 and 56, shown in FIG. 1. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Figure 2:
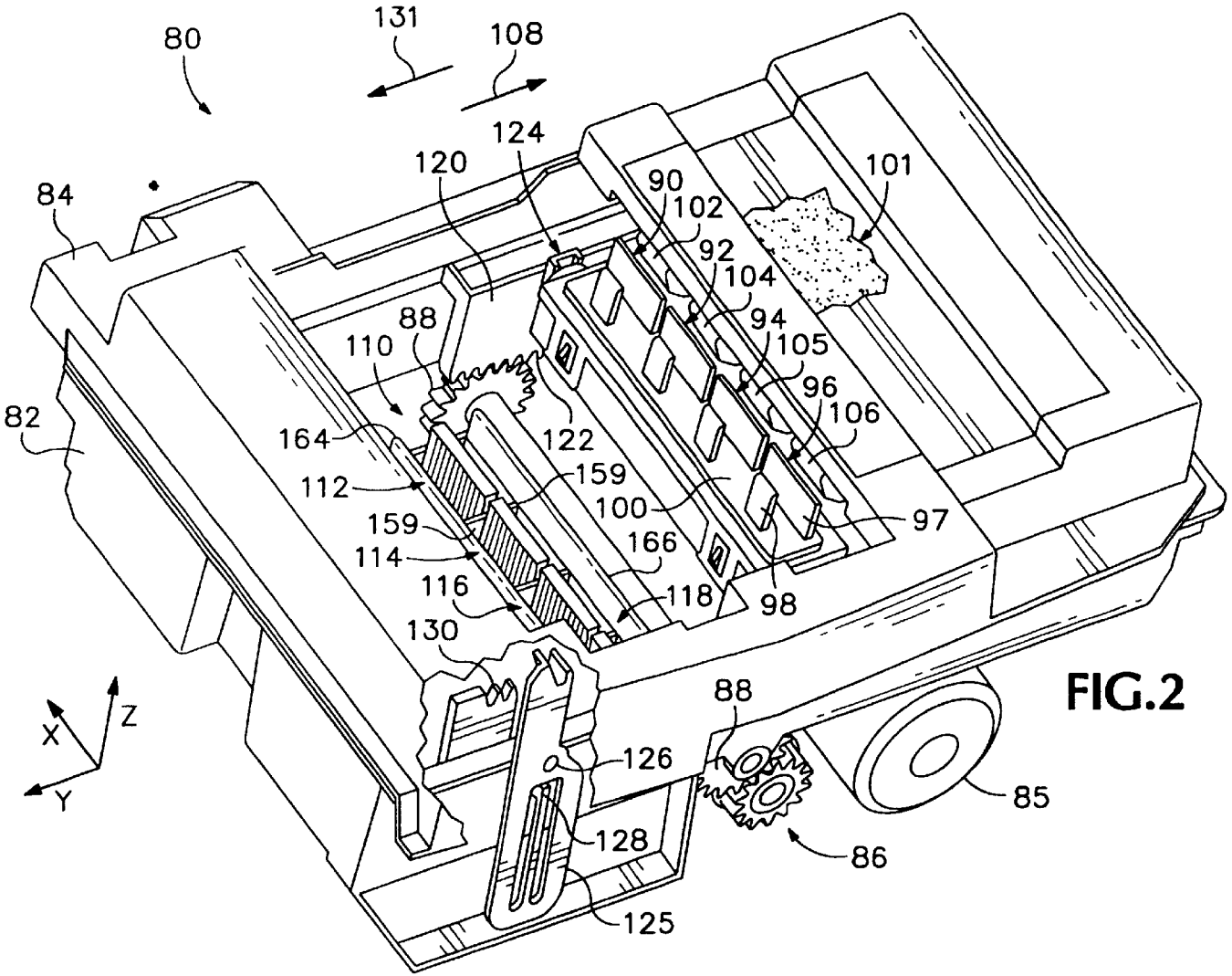
FIG. 2 is a perspective view of the service station of FIG. 1.

FIG. 2 shows one form of a two-stage wiper scraper service station 80, constructed in accordance with the present invention, where a flipping action is used to transition printhead wipers between an upright position for wiping ink residue from the printheads 70–76, and an inverted position for scraping the ink residue from the wipers. The service station 80 has a frame which includes a lower deck 82 and an upper deck 84, which may be joined together by screws, a snap fit, or other fastener devices. The frame lower deck 82 supports a service station motor 85, a gear assembly 86, and a spindle gear 88. The motor 85 drives the gear assembly 86, which in turn drives the spindle gear 88 to move various printhead servicing components into position to service each of the printheads 70–76 when in the servicing region 48. For example, four wiper assemblies 90, 92, 94 and 96 are moved through the action of motor 85, gear assembly 86 and spindle gear 88, to wipe ink residue from the printheads 70, 72, 74 and 76, respectively. Each of the wiper assemblies 90–96 has a large wiper 97, which wipes across the entire orifice plate, and a dedicated nozzle wiper 98 which concentrates on the central nozzle region of the printhead. Each of the wiper assemblies 90–96 are supported by a flipping wiper sled 100, which operates as described further below.

Other servicing components may be also supported by the service station frame 82, 84. For instance, to aid in removing ink residue from printheads 70–76, an ink solvent is used, such as a hygroscopic material, for instance polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have a large molecular size which leads to a low, almost zero, vapor pressure. This ink solvent is stored in an ink solvent reservoir 101 which is supported along an interior surface of the frame upper deck 84. For the purposes of illustration, the preferred ink solvent used by the service station 80 is PEG-300, and the solvent reservoir 101 is divided into four separate reservoirs, one for each color (black, cyan, yellow and magenta) to prevent cross contamination of the colors at the reservoir 101. The ink solvent reservoir 101 is fluidically coupled to four solvent applicator pads 102, 104, 105 and 106, which apply ink solvent to the large wiper blades 97 of the wiper assemblies 90, 92, 94 and 96, respectively, when the sled 100 is moved in a rearward direction, as indicated by arrow 108.

The service station 80 also includes a two-stage wiper scraper system 110, constructed in accordance with the present invention with four separate scraper stations 112, 114, 116 and 118 for removing ink residue from the receptive wiper assemblies 90, 92, 94 and 96 after they have wiped the ink residue from the printheads 70–76. The scraper system 110 is supported by the frame lower deck 82. A more detailed description of the operation of the scraper system 110 is given further below, with respect to a discussion of FIGS. 8–13.

Another main component of the service station 80 is a moveable platform or pallet 120, which has a rack gear 122 that is engaged by the spindle gear 88 to be driven by motor 85 and gear assembly 86 in the positive and negative Y-axis directions. The wiper sled 100 is pivotally mounted to the pallet 120, for instance using shaft 124 which is seated in bushings formed in the pallet 120 (see FIGS. 18 and 19). To transition the wipers 90–96 from an inverted position, where they may be cleaned by the scrapers 112–116, to their upright wiping position shown in FIG. 2, the service station 80 includes a trip lever 125 which is pivotally mounted at post 126 to the exterior of the frame lower deck 82. To limit rotation of the trip lever 125 around post 126, the lever 125 includes a stop member 128, which engages a pair of stop features (described further below with respect to FIG. 9) molded into the lower deck 82. The stop member 128 of the trip lever 125 is designed to have a spring action which serves to damp operation of the trip lever 125 and quiet operation of the service station 80, as well as returning the trip lever 125 to a neutral position. The service station 80 also has a tumbling or flip gear 130 formed as a stationary rack gear supported by the lower deck 82.

Figure 3:
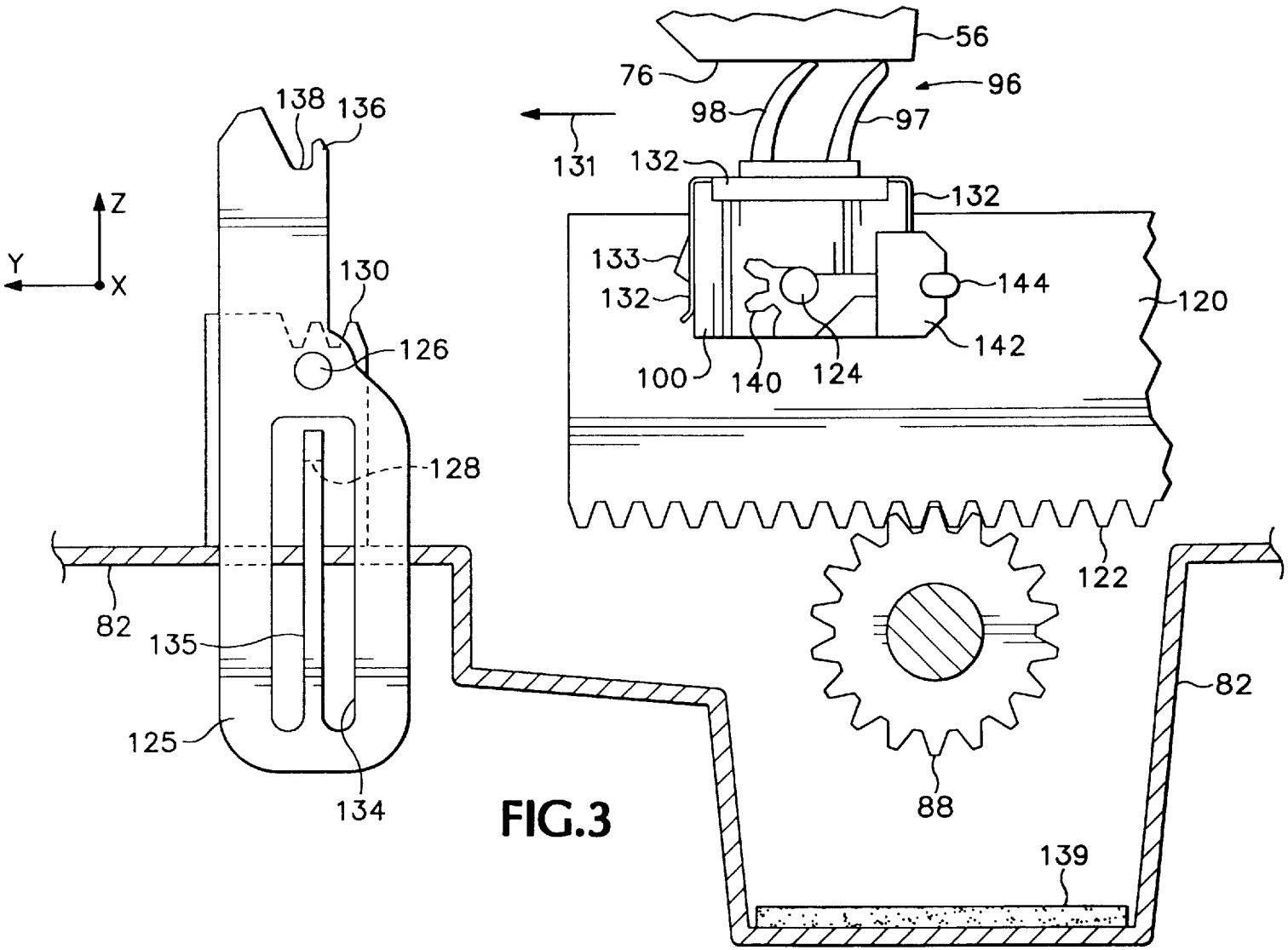
FIG. 3 is an enlarged, side elevational view of the service station of FIG. 1 shown with the wipers upright while wiping ink residue from an inkjet printhead.

FIG. 3 shows the color wiper assembly 96 wiping printhead 76 of pen 56. Prior to beginning the wiping cycle, preferably ink solvent from reservoir 101 is applied to the wiper assemblies 90–96 through rearward movement 108 of the pallet 120 which causes the wiper blades 97 to contact the solvent applicator pads 102–106, respectively. During the wiping stroke, the wiper assembly 96 is in an upright position with the spindle gear 88 engaging the pallet rack gear 122 to move the pallet bi-directionally, for instance in the rearward direction 108 and in a forward direction, as indicated by arrow 131.

FIG. 3 also shows more detail about the mounting of the wiper blades 97, 98 to the sled 100. Preferably, the wiper blades 97, 98 of assemblies 92–96 are onsert molded onto a stainless steel wiper mount 132, which is preferably snap fit over tabs 133 projecting from the sled 100. Similar mounting techniques for wiper blades have been used on earlier products, such as in the Hewlett-Packard Company's DeskJet® 720 and 722 color inkjet printers. FIG. 3 also shows other features of the trip lever 125, including an inverted U-shaped slot 134, which defines a spring arm 135 from which the stop 128 projects. The trip lever 125 also includes a thumb member 136, and a notch 138 which are used in the flipping-up operation of sled 100, to move the blades from an inverted position for scraping the wipers to the upright position for wiping, as described further below.

A couple of other features of the service station 80 are also shown in FIG. 3, including an absorbent liner 139 which rests along the bottom of the interior of the frame lower deck 82. The liner 139 may be of a cellulosic material or other equivalent materials known to those skilled in the art. FIG. 3 shows the sled 100 as having a sled flipping gear 140 which is centered around the sled pivot shaft 124. The flipping gear 140 engages the stationary flip gear 130 as described further below to rotate the sled 100 from the upright wiping position of FIG. 3, to an inverted scraping position. The sled 100 also includes a cantilevered support member 142 which extends outwardly beyond the pivot 124, that is, in the view of FIG. 3 out of the plane of the drawing sheet in the negative X-axis direction. Projecting further outwardly in the negative X-axis direction from the cantilevered support 142 is an oblong flip arm 144, which engages notch 138 of the trip lever during the flipping-up sequence as described further below. As described further below, the flip arm 144 also serves as a backup cam surface which is used to assure the wiper blades return to the upright position if other portions of the assembly fail to function as expected.

Figure 4:
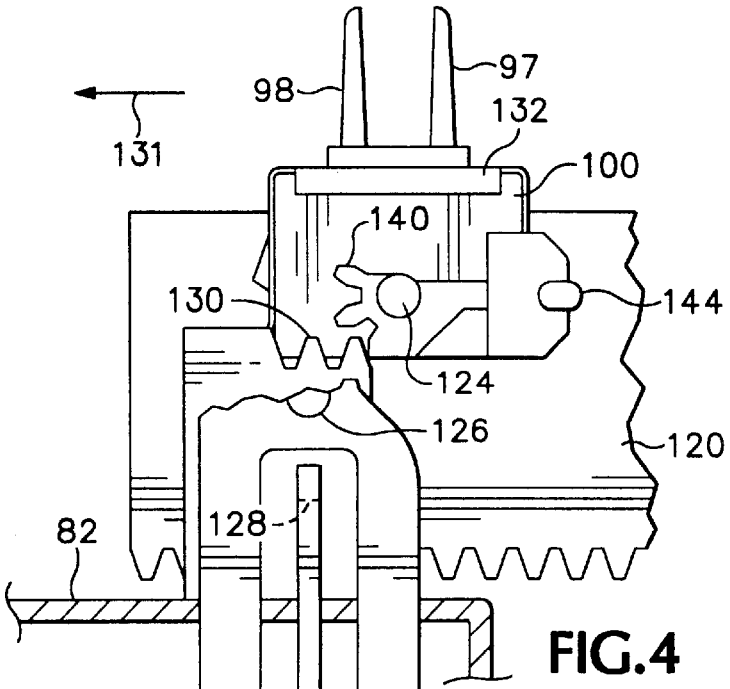
Figure 5:
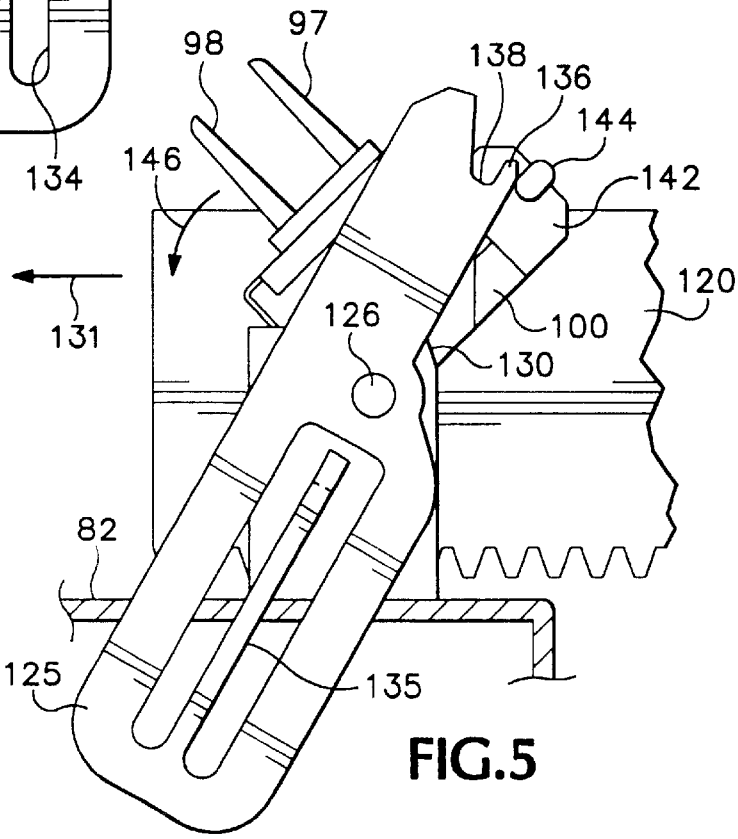

FIGS. 4–7 illustrate the flipping down sequence, where the wipers 90–96 move from the upright wiping position to the inverted scraping position. In FIG. 4, the pallet 120 has begun moving in the forward direction of arrow 131. FIG. 4 shows the fixed tumbling gear teeth 130 just before they are engaged with the sled flipping gear teeth 140. FIG. 5 shows the beginning of the flipping action, where gear teeth 130 and 140 are fully engaged, although this engagement is hidden by a portion of the trip lever 125 in FIG. 5. This engagement of teeth 130 and 140 has been caused by continued motion of the pallet 120 in the forward direction 131, which has caused the sled 100 to rotate in the direction of arrow 146. Also during this motion, the outer surface of the trip lever thumb 136 has been engaged by the flip arm 144, causing the trip lever 125 to rotate around pivot post 126 in the direction of arrow 146. This rotation of the trip lever 125 is used to place the lever in the proper position for use during the flip-up sequence.

Figure 6:
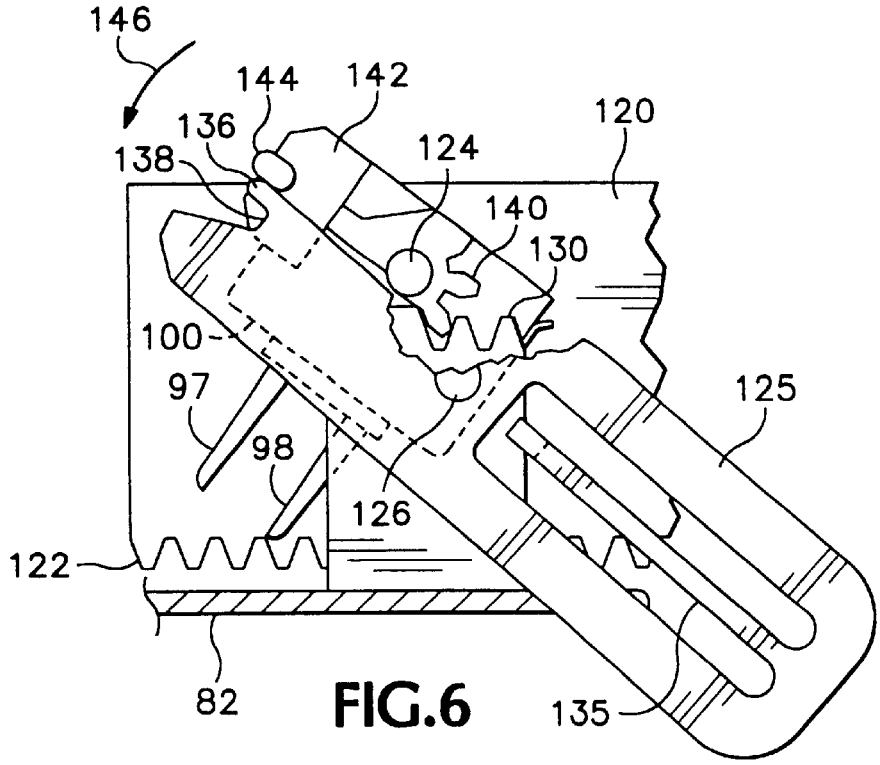
Figure 7:
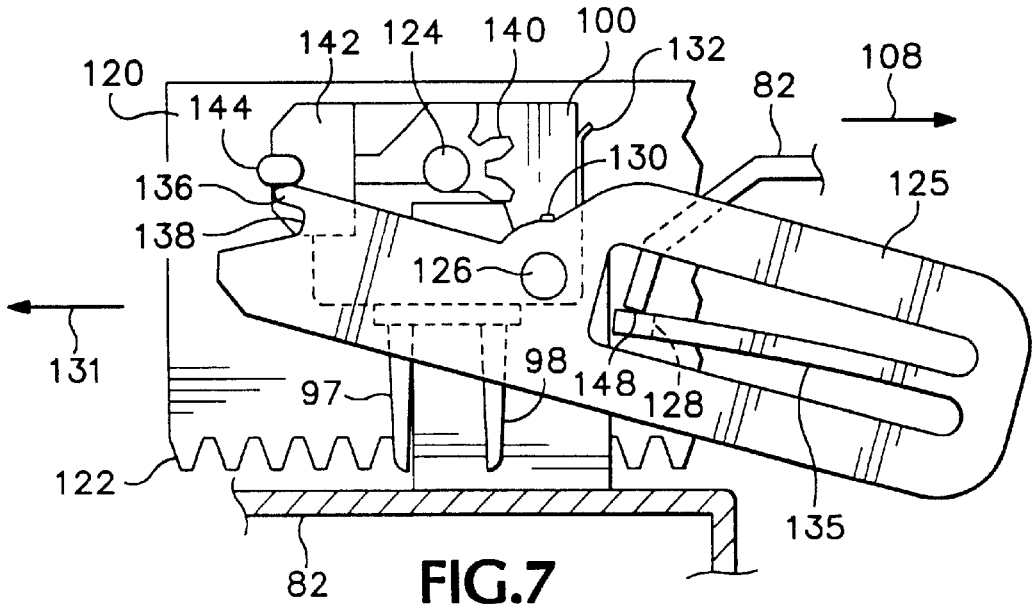

FIG. 6 shows further rotation of the sled 100 and the trip lever 125, both in the direction of arrow 146. In FIG. 6, we see the flipping gear teeth 130 and 140 in a latter stage of their engagement. FIG. 7 shows the completion of the flipping down sequence, where the wiper blades 97, 98 are now in an inverted position. The gear teeth 130, 140 are now completely disengaged and the flip arm 144 rests on the outer surface of the trip lever thumb 136. FIG. 7 shows the trip lever stop 128 contacting a bumper stop member 148 which extends from the frame lower deck 82. The spring nature of the stop arm 135 serves to actively push the trip lever thumb 136 into engagement with the flip arm 144. Note, given the spring nature of the stop arm 135, any further motion of the pallet 120 in the direction of arrow 131 beyond the position of FIG. 7 causes the flip arm 144 to fall into notch 138, a step which is reserved for the flipping up sequence described further below. Thus, from the position of FIG. 7 the pallet 120 begins traversing in the rearward direction of arrow 108 to begin the wiper scraping sequence.

Figure 8:
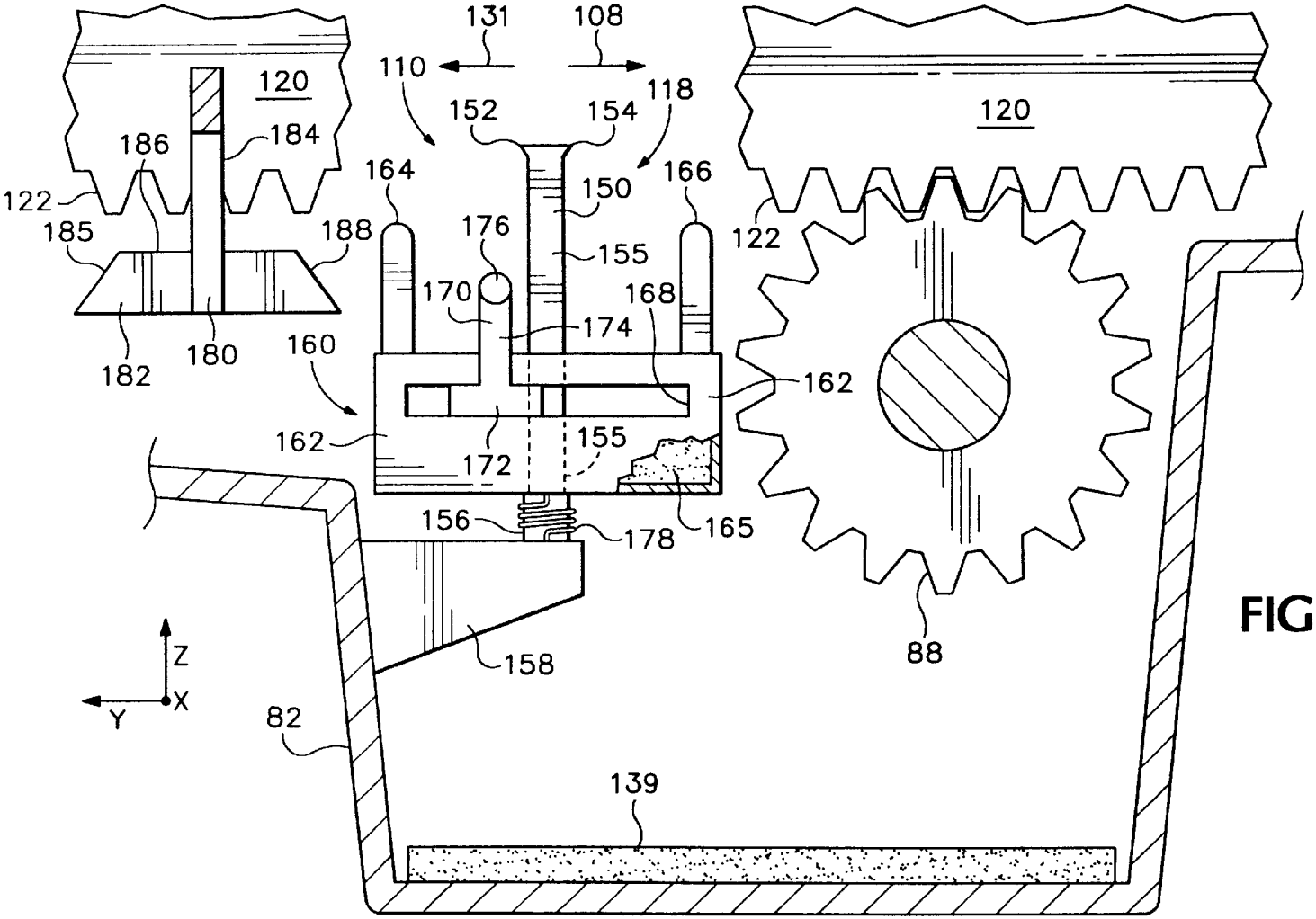
FIG. 8 is an enlarged, side elevational view of the service station of FIG. 1 showing the pallet prior to the beginning of a wiper scraping routine.
Figure 9:
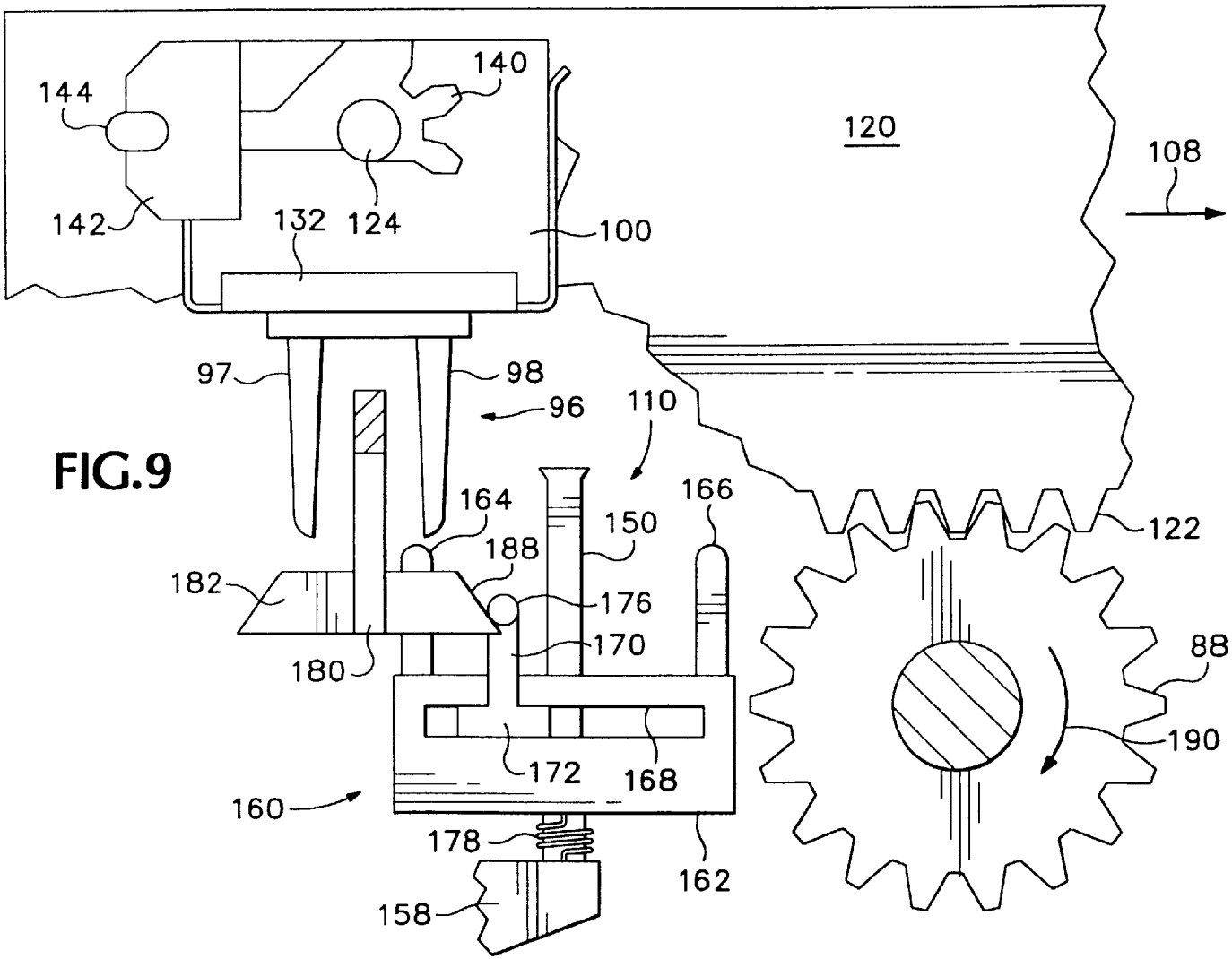

FIG. 8 illustrates the two-stage wiper scraper assembly 110 in greater detail, with scraper station 118 for cleaning the yellow printhead 76 being illustrated by way of example, as representative of each of the scraper stations 112–116 for cleaning the black, cyan and magenta wiper assemblies 90–94, respectively. In studying the operation of the earlier rigid scrapers described in the Background section above, it was found that these earlier scraper designs did a relatively good job of cleaning the sides of the wiper blades, but they often left ink residue to collect at the wiper tips. From this understanding came the two-stage wiper assembly 110, which has one stage for cleaning the front and rear facing surfaces of the wiper blades 97, 98 followed by a fine scraper stage for removing ink residue from the wiper tips.

In the illustrated embodiment, each scraper station 112–118 of the wiper assembly 110 includes a coarse wiper scraper 150, which has a roughly T-shaped cross-section with a forward facing wiping edge 152 and a rearward facing wiping edge 154. As shown in FIG. 8, a trunk portion 155 of the coarse scraper 150 may have the forward facing surface, as well as the rearward facing surface lined with a series of capillary channels, which aid in drawing liquid ink residue downwardly away from the wiping edges 152, 154 through capillary forces, as well as through the force of gravity. The coarse scraper 150 may be supported by a series of support members, such as support post 156, which are in turn supported by a support platform 158 extending from the service station frame lower deck 82. In the illustrated embodiment, the coarse scraper 150 is mounted in a stationary position with respect to the service station frame 82. As shown in FIG. 8, each of the coarse scraper segments 150 of the scraping stations 112–118 may be separated from an adjacent scraping station by a partition, such as partitions 159, which aid in preventing ink contamination from one scraping station to another.

The two-stage scraper system 110 also includes a moveable fine scraper assembly 160, which has a fine scraper support body or frame 162. Projecting upwardly from the frame 162 is a front fine scraper member 164, which is preferably constructed of the same material as the ink solvent applicators 102–106 having both absorbent properties and wicking properties to move liquid through the material under capillary forces. For instance, the fine scraper member 164 may be molded from a hard porous plastic material, such as an open-cell thermoset plastic, for instance, a polyurethane foam, a modified open cell polyurethane foam, or a sintered polyethylene, such as that sold under the trademark Porex®, manufactured by Porex Technologies, Inc. of Fairburn, Ga. In one preferred embodiment, the hardness of the fine scraper material may be selected from a durometer range of 70–100 on the Shore A scale, or more particularly from a durometer range of 75–95 on the Shore A scale, or even more particularly at a nominal durometer of 85 on the Shore A scale, plus or minus a tolerance value, such as 85+/−5 on the Shore A scale.

Optionally, the fine scraper 164 may be impregnated with an ink solvent, such as the PEG-300 ink solvent described above, which may be stored inside the solvent applicator reservoir 101. Other ink solvents may also be used. For instance, while PEG is particularly well suited for both pigment-based inks and dye-based inks, some dye-based inks may be water soluble, so water may be used as an ink solvent for the dye-based color pens 52–56 while PEG is used for the black pen's pigment-based ink. To maintain an adequate level of ink solvent inside the fine scraper 164, a portion of the frame 162 may define an ink solvent reservoir 165, which may be constructed as described above for the applicator reservoir 101. Alternatively, by making the fine scraper 164 from an absorbent material, some types of ink residue, such as certain dye-based ink residue, may be wicked away the ink residue from the scraping surface through the scraper without using any type of ink solvent. Indeed, in some implementations without solvent, even the pigment-based ink residue, along with any PEG applied by the dispenser 102, may be wicked away through the interior of such a fine scraper constructed of an absorbent material. Also projecting upwardly from the fine scraper frame 162 is a rear fine scraper member 166, which may be constructed as described for the front scraper 164, including being optionally impregnated with ink solvent from the reservoir 165.

In the illustrated embodiment, relative motion between the first coarse stage scraper 150, and the second stage fine scrapers 164, 166 into and out of the wiper path is provided by holding the coarse scraper 150 stationary, while the fine scraper assembly 160 is moved. It is apparent that other implementations may choose to move the coarse first stage scraper, while holding the fine stage scraper stationary, or both stages may be moved into and out of the wiper path. In the illustrated embodiment, the fine scraper frame 162 preferably defines one or more guide tracks, here shown as a horizontal slot 168.

The fine scraper assembly 160 also has one or more actuating members, such as a slider member 170 which may be constructed to have an inverted T-shape with a slider foot 172 being slidably received within slot 168. Extending upwardly from the slider foot 172 is a trunk portion 174 of the slider 170 which terminates in an actuator post 176. In the illustrated embodiment, the slider post 176 projects outwardly from the plane of the paper in FIG. 8, so from a front view, the slider member 170 has an inverted L-shape with the foot of the L-shape being formed by post 176 and trunk 174 serving as the upright portion of the inverted L-shape.

Preferably, the fine scraper assembly 160 is mounted to the service station frame lower deck 82 for travel vertically, in the direction of the Z-axis. FIG. 8 shows the fine scraper assembly 160 in a rest position near the support platform 158. The assembly 160 is biased into this rest position by a biasing member, here illustrated as a coiled tension spring 178. While it is apparent that other biasing means may be used, such as compression springs, leaf springs or elastic members, in the illustrated embodiment the tension spring 178 is secured at one end to the fine scraper frame 162 and at the other end to the support platform 158. Indeed, while only a single tension spring 178 is shown, for smooth operation two or more such springs or equivalent biasing members may be preferred.

Another component of the two-stage scraper assembly 110 is an actuator member 180, which includes an actuator head 182 supported at one end of a support member 184 extending downwardly from the service station pallet 120. In the illustrated embodiment, the actuation head 182 is a ramped member, having a forward facing ramp surface 185, a relatively linear cam surface 186, and a rearward facing ramp surface 188 which together form a cam surface. To raise and lower the fine scraper assembly 160, the slider post 176 acts as a cam follower by riding against the cam surfaces 185, 186, 188 of the actuator 180 as the actuator is moved forward and aft in the directions of arrows 131 and 108 by the pallet 120.

Now the components of the two-stage scraper assembly 110 are better understood, their operation in cleaning wiper blades 97, 98 will be explained with respect to FIGS. 9–13. First in FIG. 9, we see an initial stage of the scraping sequence, where through motion of the spindle gear 88 in the direction of arrow 190, the pallet 120 has begun travelling in the rearward direction of arrow 108. The rearward facing cam surface 188 of actuator 180 has engaged the slider cam follower post 176. At this stage, the slider 170 has room to allow the slider foot 172 to move inside slot 168 in the rearward direction 108, until reaching the position shown in FIG. 10. Thus, during the transition between the position of FIG. 9 and the position of FIG. 10, the fine scraper body 162 remains in a lowered rest position under the force of the tension spring 178, so the wiper blades 97, 98 pass over the front fine scraper 164 without contact.

Figure 10:
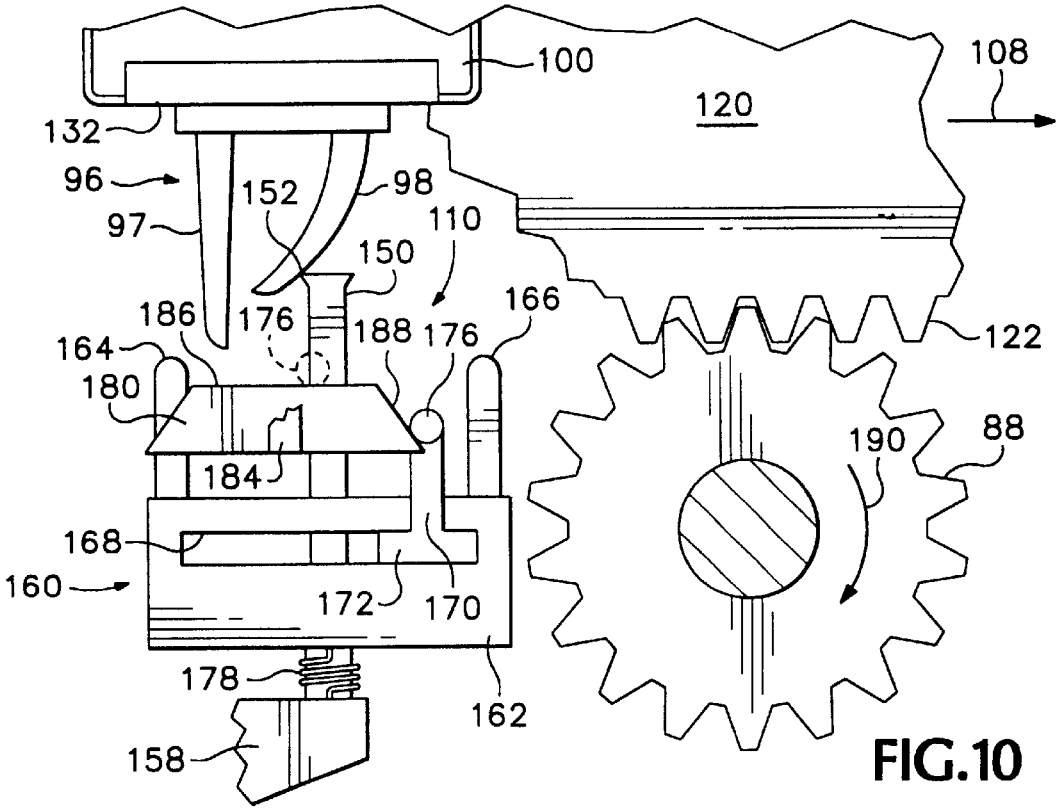

In FIG. 10 we see the rearward facing surface of wiper blade 98 having ink residue scraped away by the forward facing scraping edge 152 of the coarse wiper scraper 150. Further rearward travel in the direction of arrow 108 from the position shown in FIG. 10 brings the rearward facing surface of the other wiper blade 97 into a scraping cleaning contact with the coarse scraper edge 152. As mentioned above, liquid ink residue removed from the wiper blade surfaces may then travel downwardly along the front facing surface of the coarse scraper 150, such as within the capillary channels illustrated in FIG. 2.

From an analysis of FIG. 10, it is apparent that the slider cam follower 176, has no further horizontal distance available to travel rearwardly within the guide slot 168. Any further rearward motion of pallet 120 causes the cam follower 176 to traverse up along the ramped cam surface 188 and then along cam surface 186, transitioning through the dashed line position shown in FIG. 10. The travel of the follower 176 up the actuator ramp 188 serves to elevate the fine scraper frame 162 and scrapers 164, 166 in the direction of arrow 192 while transitioning from the position of FIG. 10 to that of FIG. 11. During this elevation of the fine scraper frame 162, the biasing spring 178 is stretched, as seen from a comparison of FIGS. 10 and 11.

In the view of FIG. 10, note that the second blade 97 to be cleaned has successfully passed over the front fine scraper 164 without contact before the scraper frame 162 begins to rise. The dashed line position of the slider cam follower 176 in FIG. 10 is the approximate horizontal location along the cam surface 186 as the actuator 180 moves under the cam follower 176, which coincides with the time when the second blade 97 encounters the coarse scraper 150, with further travel of the pallet 120 in the rearward direction of arrow 108 completing the coarse scraping stroke to remove ink residue from the rearward facing surface of blade 97. Thus, during the first coarse scraping stage, the ink residue has been removed from the rearward facing surfaces of blade 97 and 98, leaving some ink residue near the tips of the wiper blades.

Figure 11:
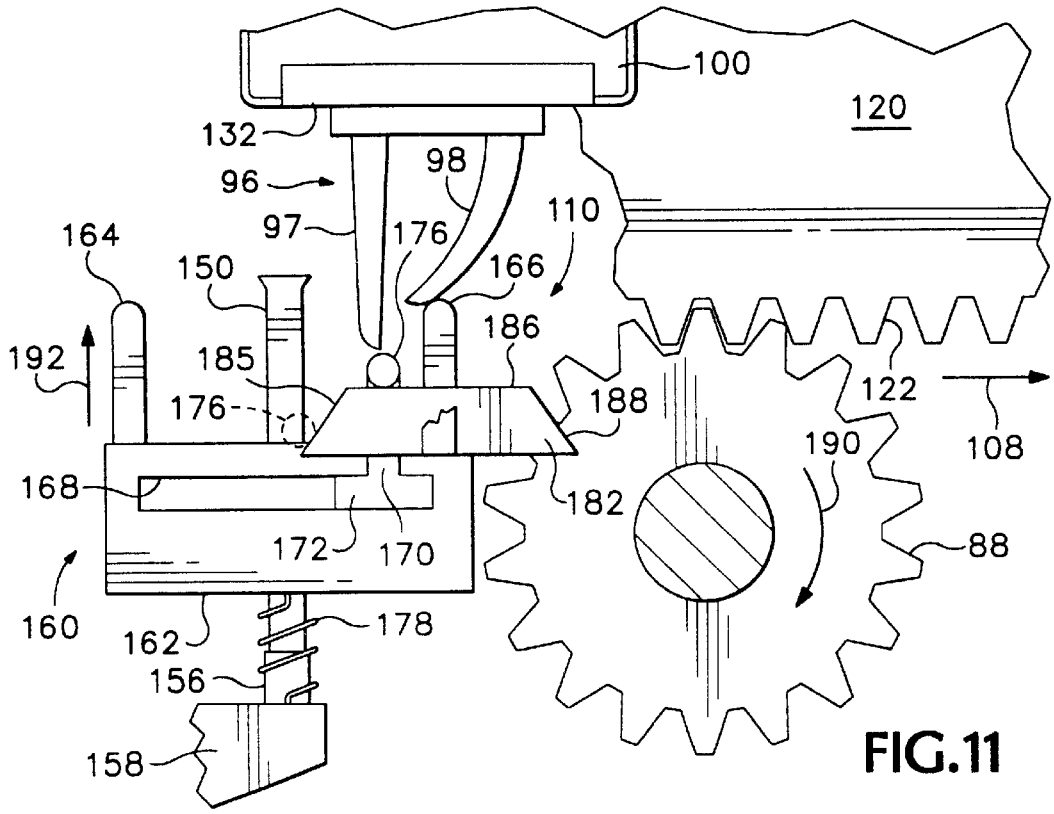

FIG. 11 shows a second scraping stage where the rear fine scraper 166 is engaged by the tip of wiper blade 98 to remove any remaining ink residue from the rearward facing portion of the blade tip. Further travel of the pallet 120 in the rearward direction of arrow 108 brings the tip of wiper blade 97 into scraping contact with the rear scraper 166, as the slider cam follower 176 continues to traverse along cam surface 186 to keep the fine scraper 166 at the elevation shown. Further rearward motion 108 of the pallet 120 eventually allows the slider cam follower 176 to move downwardly along the forward facing ramp surface 185 of the actuator 180, as shown in dashed lines in FIG. 11, leaving the slider 172 to the extreme rearward position within slot 168. As the follower 176 slides down the actuator ramp 185 while transitioning from the position of FIG. 11 to that of FIG. 12, the fine scraper frame 162 is pulled back to the rest elevation by the contraction of spring 178, as indicated by arrow 194.

Figure 12:
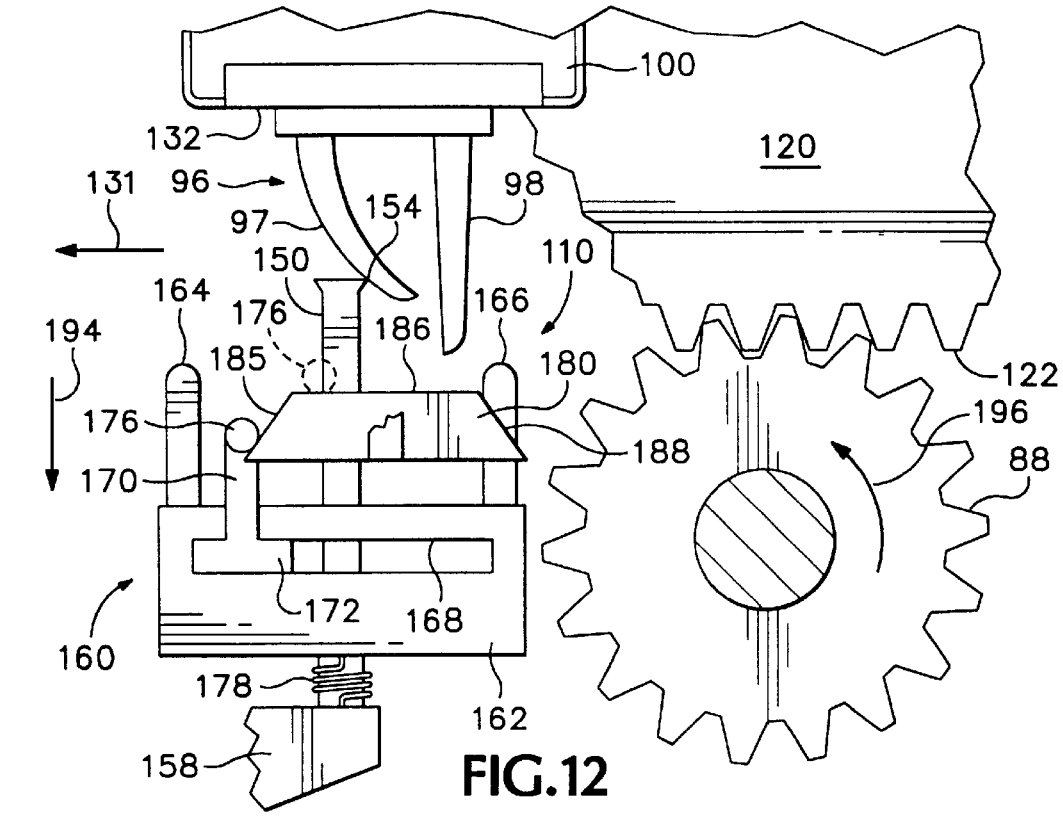

Following scraping of the tip of wiper blade 97 with the fine scraper 166, the pallet 120 stops and reverses direction, as the spindle gear 88 begins to turn in the direction of arrow 196, so the pallet 120 the travels in the forward in the direction of arrow 131 as shown in FIG. 12. This reversal of pallet travel may occur after the actuator 180 disengages from the cam follower 176, or while the actuator ramp 185 is still in contact with the cam follower 176. FIG. 12 shows a second coarse scraping stroke where the actuator ramp surface 185 has pushed the slider 170 through engagement with follower 176 to an extreme forward position, which allowed the tips of the wiper blades 97 and 98 to pass over the fine scraper 166 without contact. Thus, FIG. 12 shows the first stage of coarse scraping to remove ink residue from the forward facing surfaces of blades 97 and 98 using the wiping edge 154 of scraper 150.

As shown in FIG. 12, the rear wiper blade 98 has cleared the fine scraper member 166, readying the slider cam follower 176 to climb the actuator ramp 185 and then engage cam surface 186. The approximate horizontal position of the slider cam follower 176 along the cam surface 186 as the actuator 180 moves under the cam follower 176 is shown in dashed lines in FIG. 12 at the point in time when the blade 98 contacts the coarse scraper edge 154 to have ink residue removed from the forward facing surface of the blade. As mentioned above, the rearward facing surface of the coarse scraper 150 may also have a series of capillary channels, as shown for the frontward facing surface in FIG. 2, allowing any liquid ink residue to drain away from the scraper head 154 to be absorbed by the pad 139 (FIG. 8). In transitioning from the view of FIG. 12 to that of FIG. 13, as the pallet 120 moves forward the cam follower 176 moves up the actuator ramp 185 to move the fine scraper frame 162 and fine scrapers 164, 166 upwardly, as indicated by arrow 192, into their scraping position. During this transition, the biasing spring 178 is stretched, as shown in FIG. 13.

Figure 13:
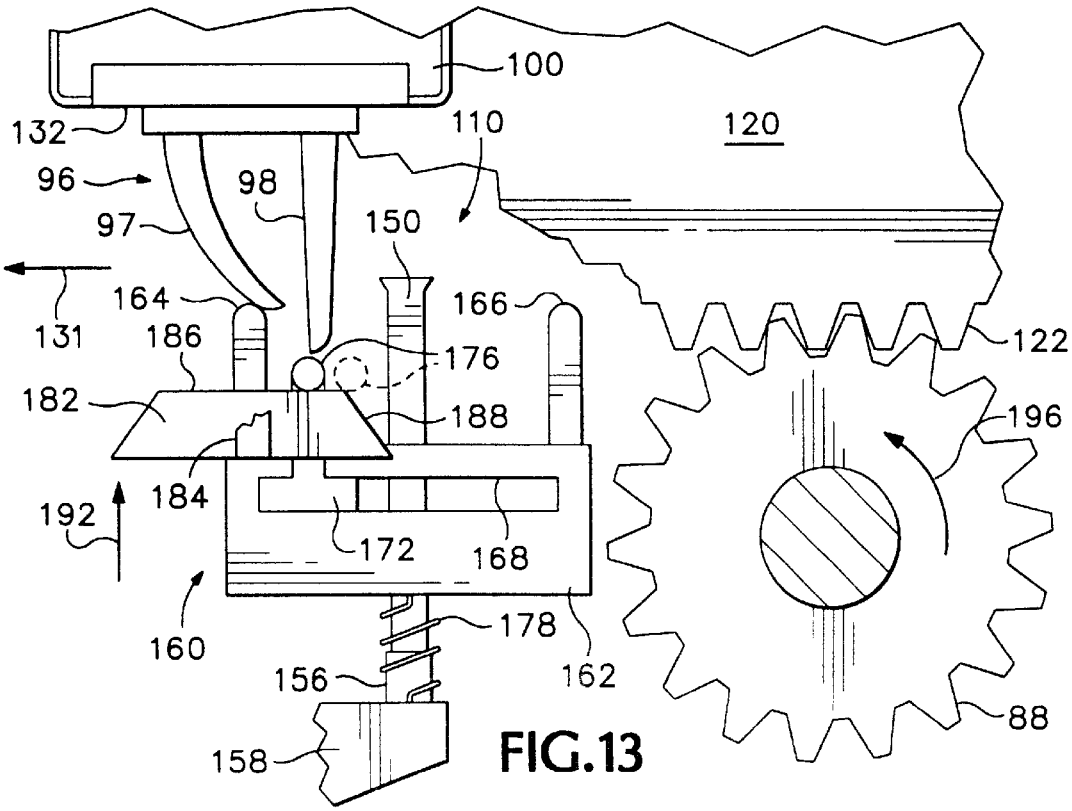
Figure 14:
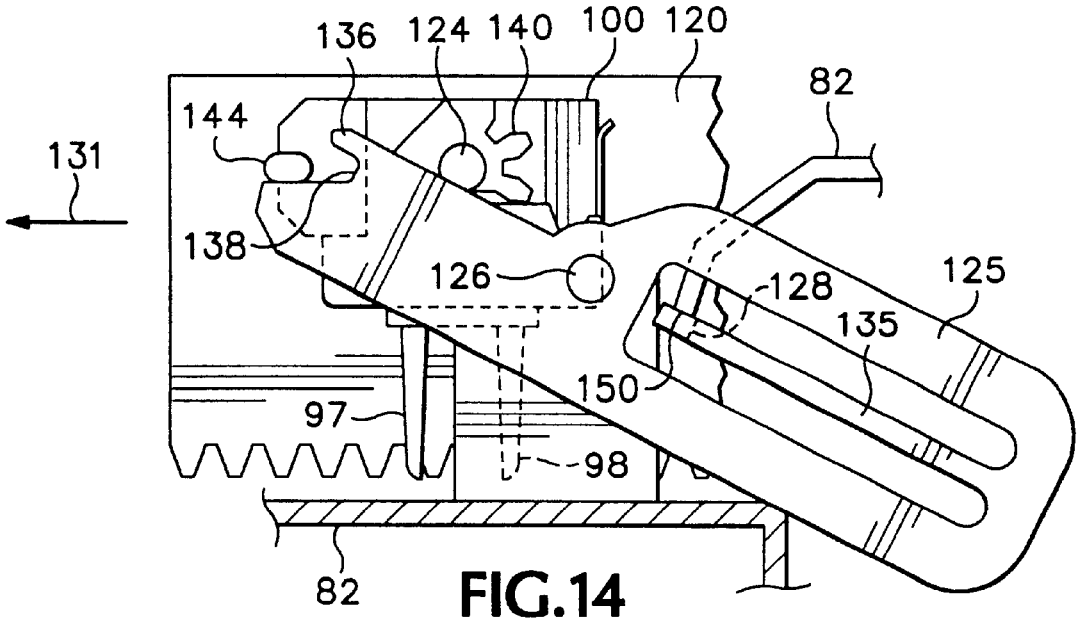

FIG. 13 shows the second fine scraping stage where ink residue is removed from the tips of blades 97, 98 by the fine scraper head 164. Here, the slider cam follower 176 has traversed along the cam surface 186 as the actuator 180 moves under follower 176, with dashed lines indicating the approximate horizontal location of the follower 176 at the time when the fine scraping stroke removes ink residue from the forward facing tip of blade 98. Continued forward travel of the pallet 120 in the direction of arrow 131 then allows the slider cam follower 176 to ride downwardly along the ramped cam surface 188, to rest approximately in the location shown in FIG. 8. During this descent of the cam follower 176, the fine scraper body 162 is pulled back into the rest position by the biasing force of the tension spring 178.

In the illustrated embodiment, the coarse scraper 150 has a greater area of engagement with the surfaces of blades 97, 98 than the fine scrapers 164, 166. In this embodiment, the interference fit, that is, the distance the wiper blade tips extend beyond the upper surface of the coarse scraper 150, was between 2.90 millimeters and 4.60 millimeters. In contrast, the interference between the wiper tips and the fine scrapers 164, 166 when elevated to a scraping position was on the order of 1–3 millimeters.

It is apparent that a variety of other implementations may be used, which still fall within the scope of the claims below, to have a coarse scraping stage for cleaning ink residue from a major portion of the flat surfaces of the wiper blades, followed by a fine scraping stage for removing ink residue remaining at the tips of the wiper blades. For instance, the vertical motion provided by the slider 170 and the actuator 180, in conjunction with the action of the biasing spring 178, may be replaced for instance by a see-saw or teeter-totter type device, or some type of rotary device, or a motor actuated system, or a system which moves in response to movement of the printhead carriage. Moreover, while the fine scrapers 164, 166 are each illustrated as having rounded scraping heads, in some implementations other configurations may be desirable, such as an angular scraping head or other combinations of angular and arcuate scraping heads. Furthermore, while the cam follower 176 is shown as extending from the fine scraper assembly 160, a reverse construction could also be used with an inverted ramp or other cam surface on the fine scraper frame 162 engaging a cam follower on the pallet 120. It is apparent that other modifications may be made to sequentially engage a coarse scraper and a fine scraper with the wiper blades.

Figure 15:
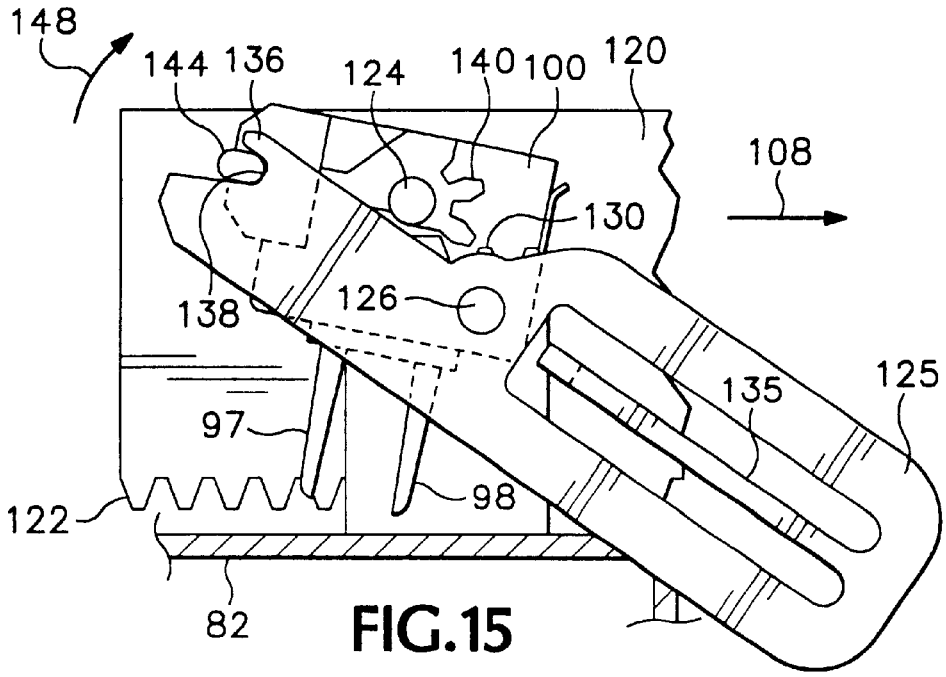

FIGS. 14–17 show the flipping up sequence which follows the scraping operation of FIGS. 8–13. In comparing FIG. 14 with FIG. 7, it is seen that the pallet 120 in FIG. 14 has moved further in the forward direction 131 than in FIG. 7. This extreme forward motion of the pallet 120 has caused the flip arm 144 to move beyond the trip lever thumb 136. Under the biasing force supplied by the trip lever spring arm 135, and the engagement of the stop 128 with the frame bumper 148 (FIG. 7), the flip arm 144 has dropped down into a position ready to engage trip the lever notch 138, as shown in FIG. 15.

Figure 16:
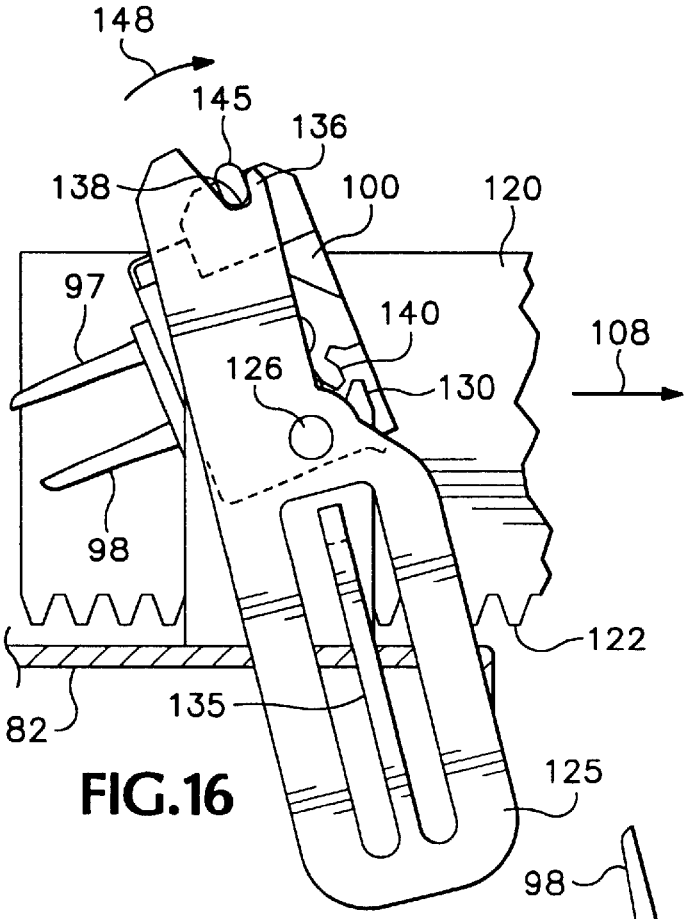

In FIG. 15, the pallet 120 has begun to move in the rearward direction 108, causing the sled 100 to begin pivoting around the shaft 124 in the direction of arrow 148. Through engagement of the flip arm 144 and the trip lever notch 138, this rearward motion of pallet 120 causes the trip lever 125 to pivot around post 126 also in the direction of arrow 148. Engagement of the flip arm 144 and the trip lever notch 138 forces the sled 100 to rotate into the upright position as the pallet 120 continues moving in the rearward direction 108, as shown in FIG. 16. This rotation of the sled 100 is also assisted by engagement of the flip gears 130 and 140.

Figure 17:
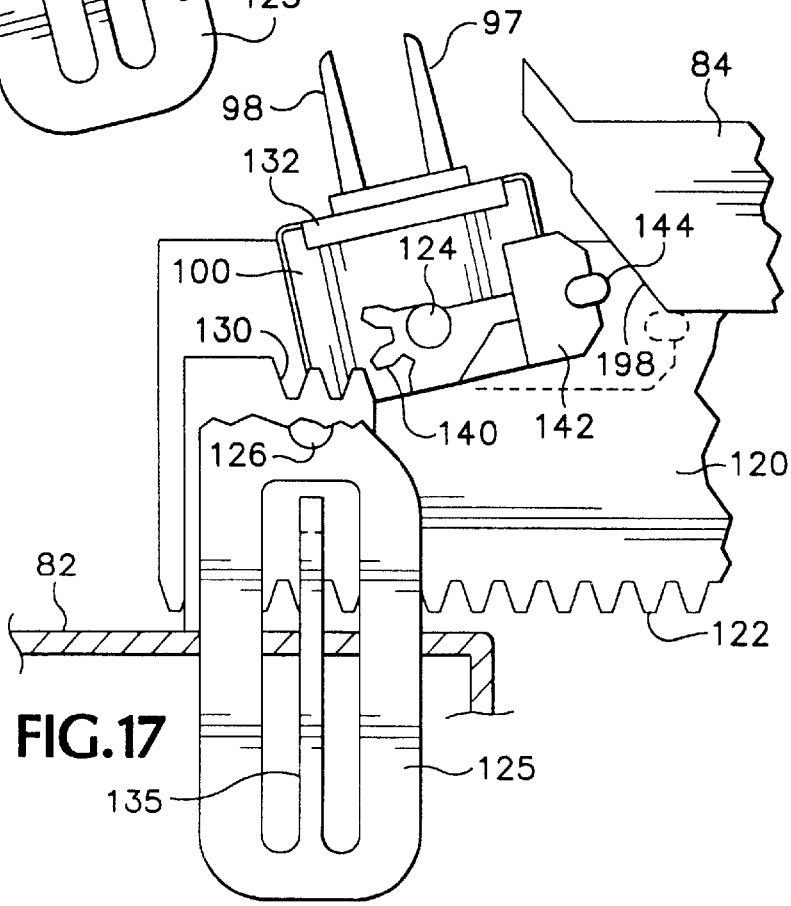

FIG. 17 shows the sled 100 nearing the completion of its rotation in the direction of arrow 148. In FIG. 17, we see the flipping gears 130 and 140 are now disengaged. In prototype units, it was found that occasionally during this flipping up sequence, the sled 100 did not return to a fully upright position, remaining at a slight angle, as shown in FIG. 17. To accommodate these occasional instances where the sled 100 did not return to a full upright position, the backup cam surface of the flip arm 144 was formed to engage a cam surface 198 formed on a portion of the frame upper deck 84 during wiping and scraping. Following engagement of cam surfaces 144 and 198, FIG. 17 shows the sled 100 in dashed lines in a fully upright position ready to perform a wiping stroke. To assist in aligning the sled 100 and pallet 120, as well as preventing the sled from rotating under torsional forces generated during the wiping and scraping operations, the flip arm 144 may ride along in a groove or slot (not shown) defined by the interior surface of the frame upper deck 84 and/or the frame lower deck 82. In FIG. 17, the trip lever 125 has been left in a roughly upright position, awaiting contact by the flip arm 144 for presetting, as described above with respect to FIGS. 5–7.

Figure 18:
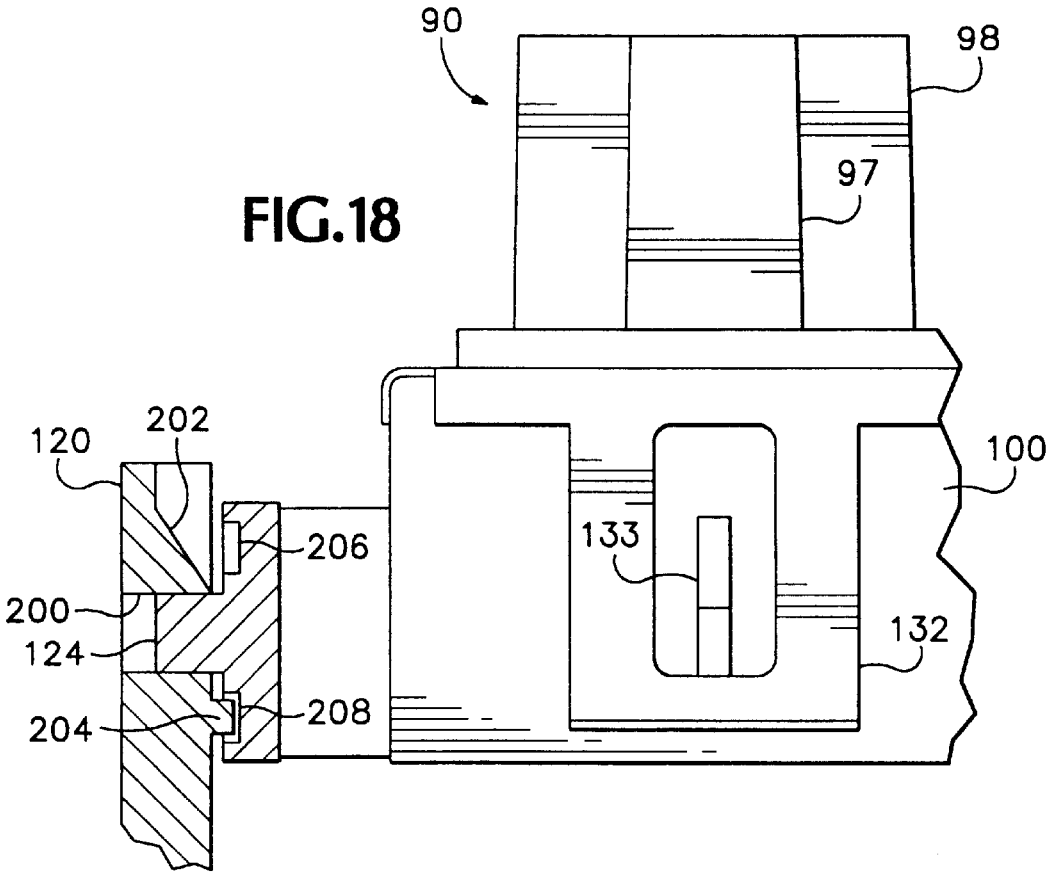
Figure 19:
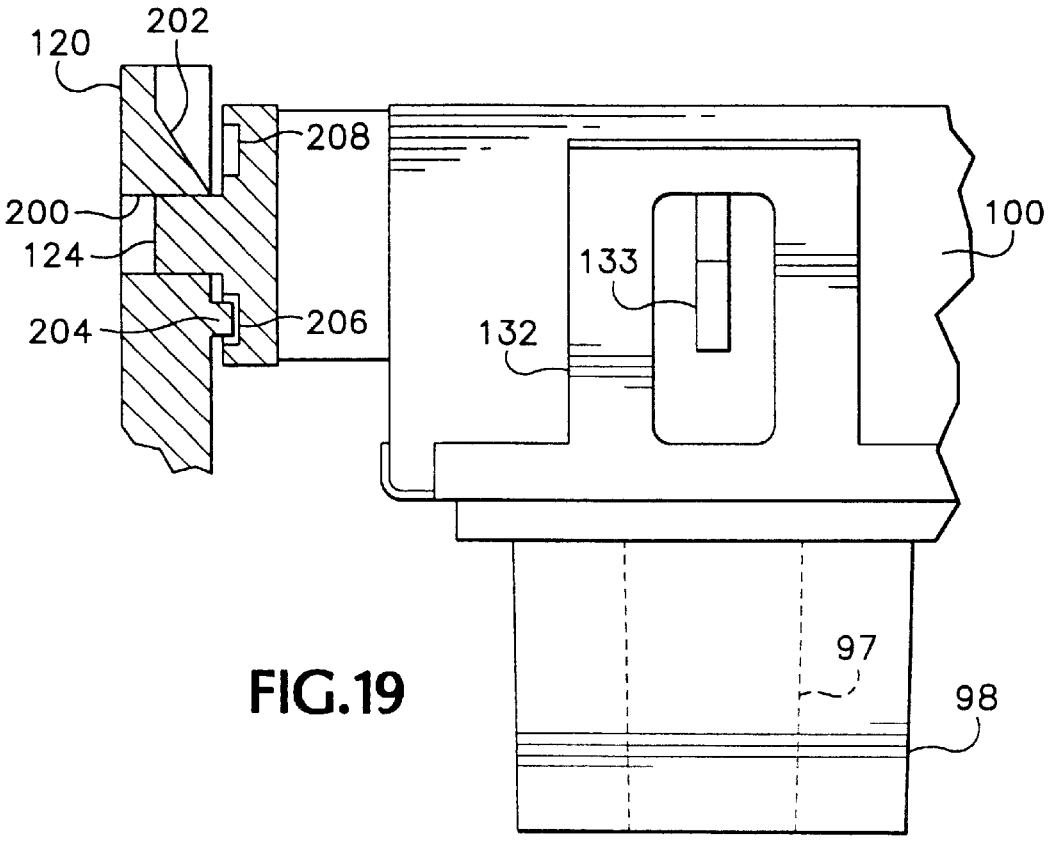

FIGS. 18 and 19 illustrate one manner of securing the sled 100 in the upright wiping position and in the inverted scraping position. One end of the sled pivot shaft 124 is shown riding within a bushing member 200 defined by pallet 120. The bushing portion 200 includes a guide ramp 202 which is used during assembly to flex this portion of the pallet outwardly as the sled is snapped into place. The opposite end of the sled 100 may be assembled to the pallet 120 in a similar fashion. The pallet 120 has a projection or detent member 204 which fits into either one of two slots 206 or 208 formed within the sled 100. As shown in FIG. 18, to secure the wiper blades in the upright wiping position, the detent 204 is engaged with slot 208. The wiper blades 97, 98 are held in the inverted scraping position through engagement of detent 204 with slot 206, as shown in FIG. 19. Understanding now how the sled 100 is held in both the upright and inverted positions, it will be better appreciated the necessity of providing the backup cam surfaces 144 and 198 to force sled 100 into the upright position so projection 204 can fully engage slot 208.

In operation, following dabbing of the wipers 90–96 against the ink solvent applicator pads 102–106, the printheads 70–76 are wiped as shown in FIG. 3. Before beginning the flip-down sequence, the carriage 45 moves the pens 50–56 out of the servicing region 48 to avoid contact with a capping assembly (not shown) which may also be carried by the pallet 120. This movement of the pens 50–56 out of the servicing region may be to return to a print job, advantageously saving time by allowing printing and scraping to occur simultaneously, which increases print speed and throughput (a printer rating measured in pages per minute). Following printhead wiping, the wiper sled 100 undergoes the flip-down sequence shown in FIGS. 4–7. FIGS. 8–13 then show the two-stage scraping sequence, where one surface of the wiper blades is first engaged by the coarse scraper 154, and ink residue remaining in the tips of the wipers is removed by the ink solvent impregnated fine scraper 166. Following the second stage fine scraping step, the pallet 120 reverses its direction to clean ink residue from the opposing surfaces of the wiper blades. The wiper blades 97, 98 first pass over the fine scraper 166 without contact, then have a majority of the opposing blade surface scraped of ink residue by the coarse scraper 150 as shown in FIG. 12. During a portion of this coarse scraping sequence, the fine scraper assembly 160 is moved from the rest position of FIG. 12 into the fine scraping position of FIG. 13, where ink residue is removed from the tips of wiper blades 97, 98. Following the scraping sequence of FIGS. 8–13, the flipping up sequence of FIGS. 14–17 is preformed, leaving the wiper assemblies 90–96 in position ready for another printhead wiping routine.

Conclusion

Thus, a variety of advantages are realized using the two-stage wiper scraper service station 80, and several of these advantages have been noted above. One particular advantage of the two-stage scraper system 110 described herein is the ability to use ink solvent impregnated fine scrapers 164 and 166, with the ink solvent dissolving and retaining within the fine scrapers 164, 166 any troublesome ink residue clinging to the wiper tips. Another advantage of the rounded scraper heads 164, 166 is that the tips of the wiper blades 97, 98 ride smoothly along the rounded surfaces, leaving a longer opportunity for contact with the wiper tips and less flicking off of ink solvent from wiper tips because of the more gradual release of potential energy stored in the wiper blade from being bent through contact with the scraper.

Use of the two-stage scraper system 110 of service station 80 also advantageously allows ink residue to be removed first in a coarse fashion from the large surfaces of the wiper blades, followed by a fine scraping stroke where ink residue remaining on the wiper tips is advantageously removed through contact with the fine scrapers 164, 166. This detailed scraping of the tips of wiper blades 97, 98 of each of the assemblies 90–96 advantageously allows ink residue to be removed from the wiper tips. This two stage scraping system is a vast improvement over the methods used in the earlier service stations, where a single coarse wiping stage often left ink residue accumulated on the tips to later contaminate the printhead and/or the main solvent applicator pads 102–106 during the next wiping sequence.

Furthermore, use of the separate fine scrapers 164, 166 allows for their construction to be different than that of the coarse scraper 150. In the illustrated embodiment, the fine scrapers 164, 166 are made of a hard porous plastic material, which may be the same as that used for the applicator pads 102, 106, allowing the fine scrapers to be impregnated with an ink solvent. Additionally, using of the fine scraper body 162 to serve as a reservoir 165 for storing a supply of ink solvent advantageously allows the fine scrapers 164, 166 to continue to clean the wiper tips over the lifetime of the printing unit. Finally, as mentioned above the inventive concepts described herein by way of the illustrated embodiment of FIGS. 1–19 may be implemented in a variety of different ways which still fall within the scope of the claims below. For instance, other mechanisms may be used to first engage a coarse scraper with the main body portion of the wiper blade or blades, and then to engage a fine scraper with the wiper tips to provide a detailed cleaning of the wiper tips. Thus, the illustrated printer 20 with a two-stage wiper scraper system, such as embodied in system 110 of service station 80, advantageously maintains printhead health to provide consumers with a robust, reliable inkjet printing unit which will continue to provide consumers with high quality images over the lifetime of the unit.

We claim:

1. A wiper cleaning system for cleaning ink residue from a wiper which has wiped ink residue from an inkjet printhead in an inkjet printing mechanism, comprising:

a coarse scraper which removes the ink residue from a main body portion of the wiper through relative movement of the wiper and the coarse scraper, and leaving a portion of the ink residue remaining on a tip portion of the wiper; and a fine scraper which removes the remaining ink residue from the tip portion of the wiper through relative movement of the wiper and the fine scraper.

2. A wiper cleaning system according to claim 1 wherein:

the relative movement of the wiper and the coarse scraper comprises holding the coarse scraper stationary while moving the wiper through a coarse scraping stroke; and the relative movement of the wiper and the fine scraper comprises holding the fine scraper stationary while moving the wiper through a fine scraping stroke.

3. A method of cleaning ink residue from an inkjet printhead in an inkjet printing mechanism, comprising the steps of:

providing a wiper, a coarse scraper, and a fine scraper, with the wiper having a main body portion and a tip portion;

wiping ink residue from an inkjet printhead with the wiper, and collecting the ink residue on the main body portion and tip portion of the wiper;

through relative movement of the wiper and the coarse scraper, removing ink residue from the main body portion of the wiper, and leaving a portion of the ink residue remaining on a tip portion of the wiper; and through relative movement of the wiper and the fine scraper, removing ink residue from the tip portion of the wiper.

4. A method according to claim 3 wherein:

the step of removing ink residue from the main body portion of the wiper comprises moving the wiper while holding the coarse scraper stationary; and the step of removing ink residue from the tip portion of the wiper comprises moving the wiper while holding the fine scraper stationary.

5. An inkjet printing mechanism, comprising:

a frame;

an inkjet printhead supported by the frame for movement between printing positions for printing and a servicing position for receiving printhead servicing;

a wiper which wipes ink residue from the printhead during a wiping stroke when the printhead is in the servicing position, with the wiper having a main body portion which terminates in a tip portion;

a platform which supports the wiper for movement through a wiping stroke to wipe the ink residue from the printhead and a scraping stroke having a first stage and a second stage;

a coarse scraper supported by the frame to remove the ink residue from the main body portion of the wiper during the first stage of the scraping stroke while leaving a portion of the ink residue remaining on the tip portion of the wiper; and a fine scraper which removes the remaining ink residue from the tip portion of the wiper during the second stage of the scraping stroke.

6. An inkjet printing mechanism according to claim 5 wherein the platform which supports the wiper during the wiping stroke is in an inverted position during the scraping stroke.

* * * * *